US007532733B2

(12) United States Patent
Saltykov

(10) Patent No.: US 7,532,733 B2
(45) Date of Patent: May 12, 2009

(54) FEEDBACK REDUCING RECEIVER MOUNT AND ASSEMBLY

(75) Inventor: Oleg Saltykov, Fair Lawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 997 days.

(21) Appl. No.: 10/945,704

(22) Filed: Sep. 21, 2004

(65) Prior Publication Data

US 2005/0074138 A1 Apr. 7, 2005

Related U.S. Application Data

(63) Continuation-in-part of application No. 10/610,449, filed on Jun. 30, 2003.

(51) Int. Cl.
*H04R 25/00* (2006.01)

(52) U.S. Cl. ..... 381/324; 381/322

(58) Field of Classification Search ..... 381/312, 381/318, 322, 324, 325, 328; 181/130, 135, 181/171, 172

See application file for complete search history.

(56) References Cited

U.S. PATENT DOCUMENTS 5,204,917 A * 4/1993 Arndt et al. ..... 381/324
6,920,414 B2 * 7/2005 Tøpholm ..... 381/328

* cited by examiner

*Primary Examiner*—Brian Ensey

(57) ABSTRACT

A flexible support for a hearing instrument receiver suspended on a receiver tube in a hearing instrument housing will lessen the feedback that could be generated if the housing is jostled. A mounting assembly affixed to the receiver and anchored to the housing functions in this manner, and also improves the stability of the receiver inside the housing.

17 Claims, 13 Drawing Sheets

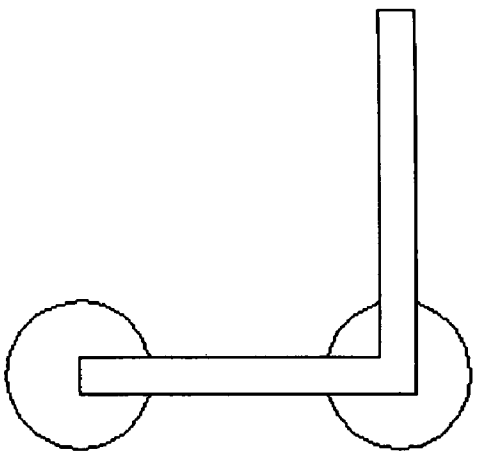
Fig. 13
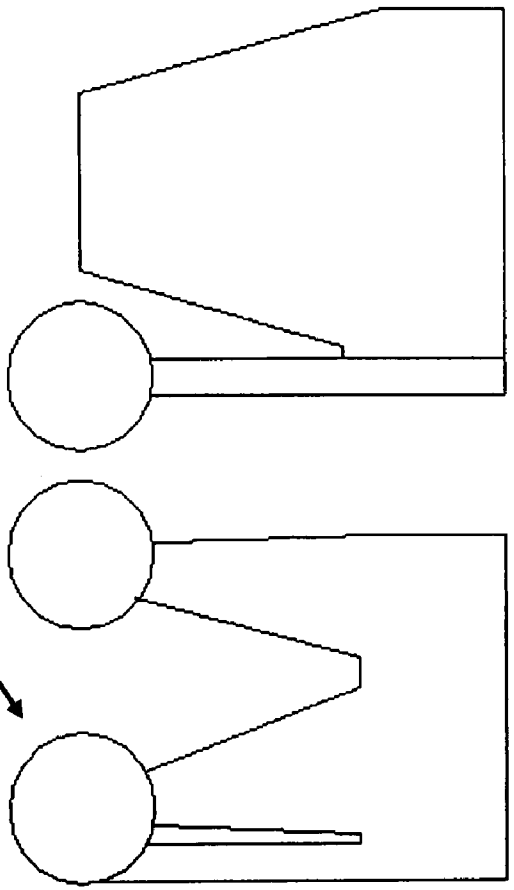
Fig. 11
Fig. 12

MODELING PROCEDURE

FEEDBACK REDUCING RECEIVER MOUNT AND ASSEMBLY

CROSS-REFERENCE TO RELATED APPLICATION

This application is related to U.S. patent application Ser. No. 09/887,939 filed Jun. 22, 2001, incorporated by reference herein and is a continuation in part of U.S. patent application Ser. No. 10/610,449 filed Jun. 30, 2003.

BACKGROUND AND SUMMARY OF THE INVENTION

The receiver of a hearing instrument, the component that generates the sound heard by the instrument's user, contains an electro-mechanical transducer similar to a loudspeaker held within an enclosure. If the receiver comes into physical contact with the inside of the hearing instrument or perhaps another component, vibration generated by the action of the receiver may be transferred to the housing. It might then be picked up by the microphone, amplified, and provided to the input of the receiver, thus resulting in feedback. A resilient and compliant mount for the receiver can help prevent the creation of such a feedback path.

In one arrangement, the receiver is supported on one side by a semi-rigid receiver tube. A receiver mounting assembly such as a flexible tether having resilient qualities, made from a material such as rubber or an elastomer, supports and anchors the other side of the receiver. Alternatively, studs fashioned from a material such as rubber or an elastomer and projecting outwardly from opposite faces of the receiver and positioned in a cradle on the inside wall of the housing may also be employed.

Another structure for supporting a receiver utilizes receptacles attached to or integral with the inside wall of the housing. The receptacles mate with mounting elements attached to the receiver assembly.

BRIEF DESCRIPTION OF THE DRAWINGS

FIGS. 11-13 are orthogonal views of a tether having two anchor points;

DESCRIPTION OF THE INVENTION

Figure 1:
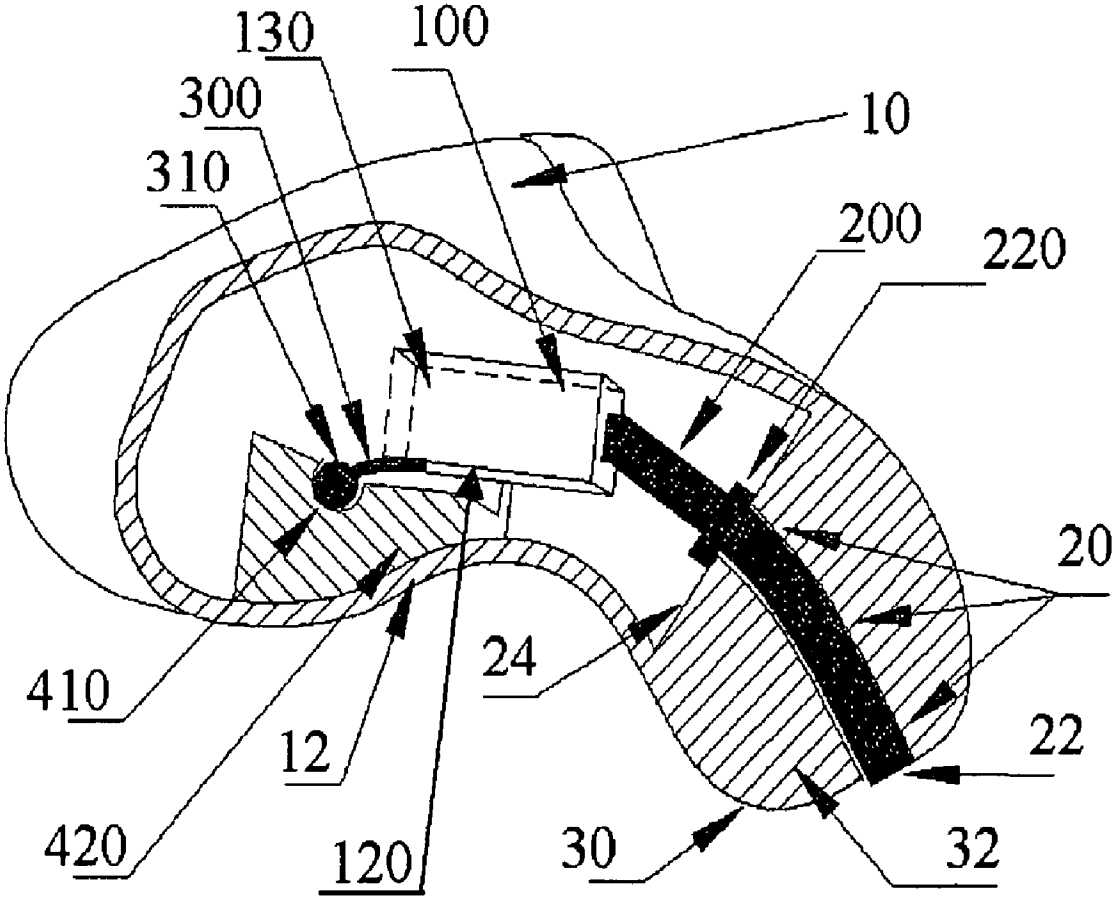
FIG. 1 is a partial cross-sectional view of a hearing instrument housing.
Figure 2:
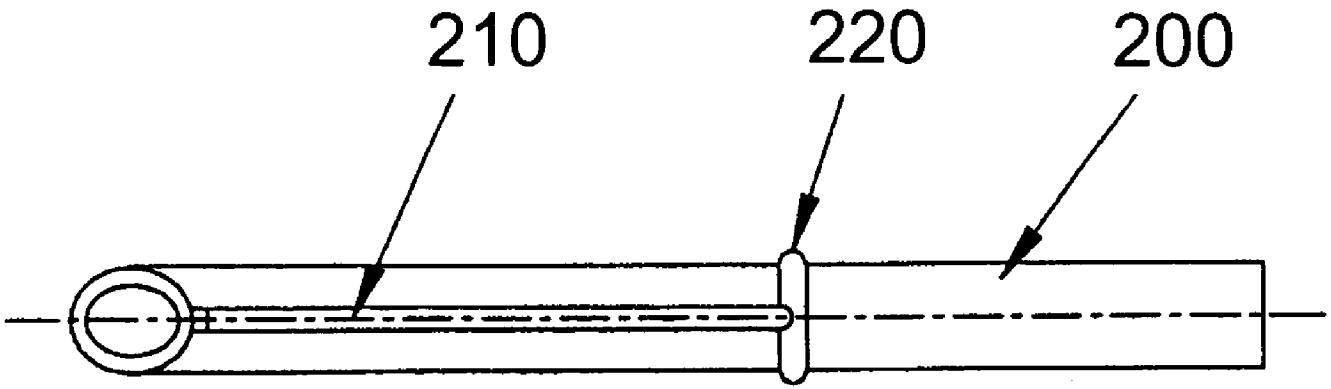
FIGS. 2 and 3 are exterior and cross-sectional views, respectively, of a receiver tube.
Figure 3:
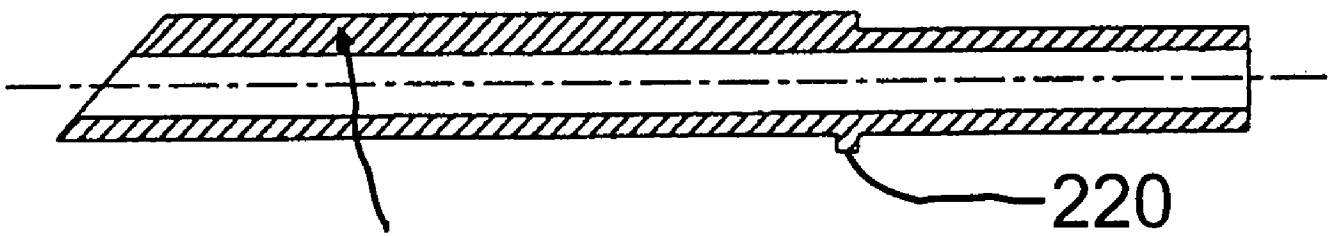

FIG. 1 is a partial cross-sectional view of a hearing instrument housing 10 and a receiver assembly 100 (enclosing the receiver mechanism) positioned therein. A flexible receiver tube 200 having some degree of resilience and compliance, also shown in FIGS. 2 and 3, is attached to the receiver assembly 100 to convey sound to the outside of the instrument housing 10.

The tube 200 may be fabricated from a synthetic material such as an elastomer or any other suitable material. One such elastomer is marketed by DuPont Dow Elastomers, L.L.C. under the trademark Viton. A passage 20 within the instrument housing 10 accepts the receiver tube 200 and, in conjunction with the tube 200, provides support for the receiver assembly 100. The flexible receiver tube 200 reduces the vibration that would otherwise be induced in the housing 10 when the transducer mechanism within the receiver assembly 100 operates. Further, should the hearing instrument be dropped, the tube 200 would absorb some of the stress induced by the impact and prevent the receiver assembly 100 from shifting its position within the hearing instrument housing 10.

In FIG. 1, a receiver mounting assembly 300 fashioned here as a tether (and referred to hereafter as tether 300) and attached to an edge 120 of the receiver assembly 100 functions as an anchor and may also provide support to the receiver assembly 100. The tether 300 exhibits the properties of resilience and compliance, and may be fabricated from a flexible material such as the previously-mentioned Viton elastomer or another similar material, and may be affixed to the receiver assembly 100 with a glue such as a held in a socket 410 fabricated in the wall 12 of the housing 10 (assuming the necessary degree of thickness) or in an optional platform 420 extending out from the wall 12, or in some other suitable fixture. To further secure the tether 300, glue may be applied to the ball 310 to insure that it remains in the socket 410.

If supported solely by the receiver tube 200, given sufficient force, the receiver assembly 100 could shift within the housing 10, making contact with the wall 12 of the housing or perhaps another component within the housing 10, and providing a path for feedback. To prevent this from happening, the receiver assembly 100 may be secured within the instrument housing 10.

In FIG. 1, a receiver mounting assembly 300 fashioned here as a tether (and referred to hereafter as tether 300) and attached to an edge 120 the receiver assembly 100 functions as an anchor and may also provide support to the receiver assembly 100. The tether 300 exhibits the properties of resilience and compliance, and may be fabricated from a flexible material such as the previously-mentioned Viton elastomer or another similar material, and may be affixed to the receiver assembly 100 with a glue such as a held in a socket 410 fabricated in the wall 12 of the housing 10 (assuming the necessary degree of thickness) or in an optional platform 420 extending out from the wall 12, or in some other suitable fixture. To further secure the tether 300, glue may be applied to the ball 310 to insure that it remains in the socket 410.

Alternatively, another shape and securing mechanism could be substituted for the ball 310 and the socket 410, such as a wedge, a hook, or a ring that mates with a post. Alternatively, a slot provided in the housing 10 could receive the tether 300 and then secured with glue.

Figure 4:
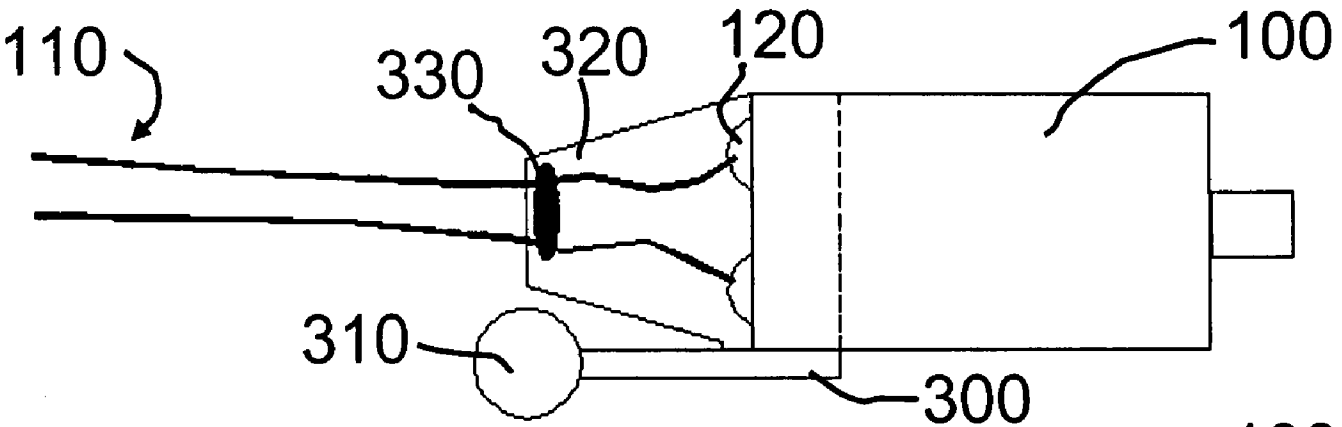
FIGS. 4 and 5 are two orthogonal views of a receiver with a tether.
Figure 5:
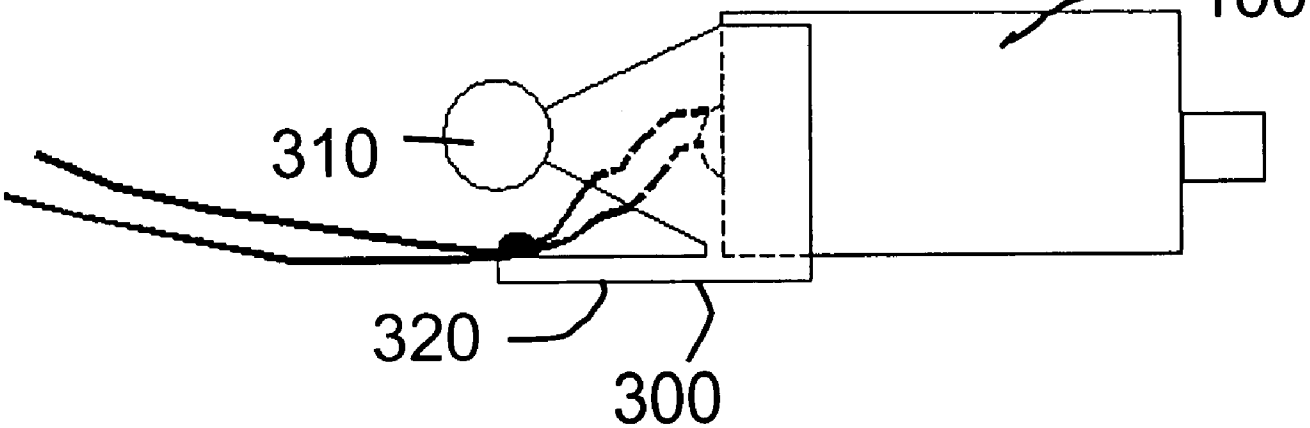
Figure 8:
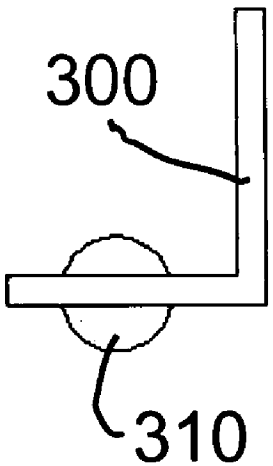
FIGS. 6-8 are orthogonal views of the tether of FIGS. 4 and 5.
Figure 6:
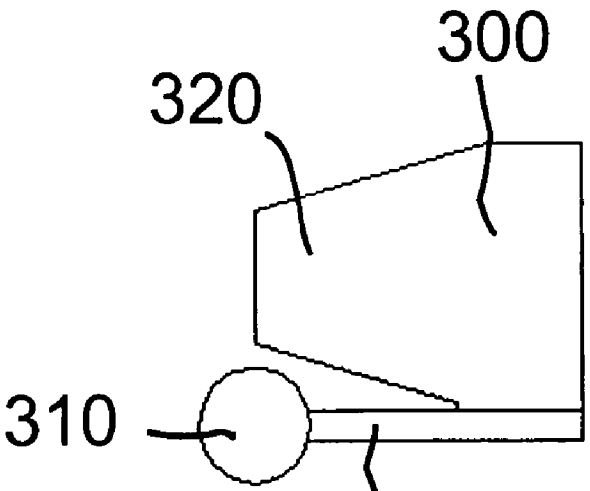
Figure 7:
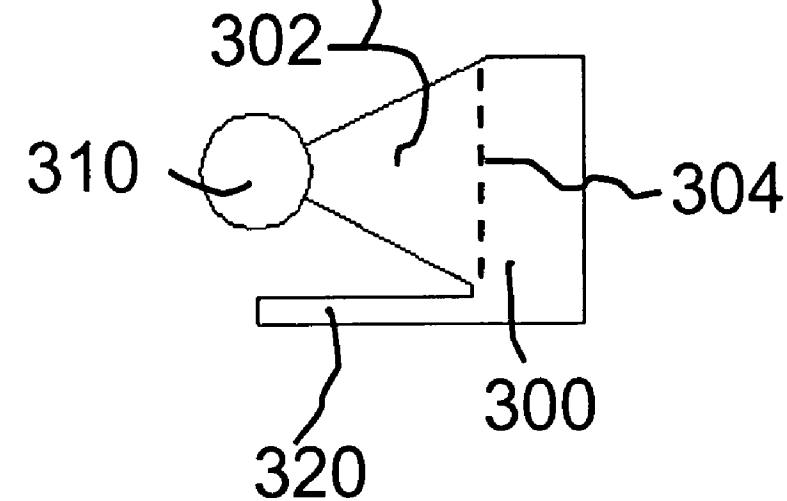
Figure 9:
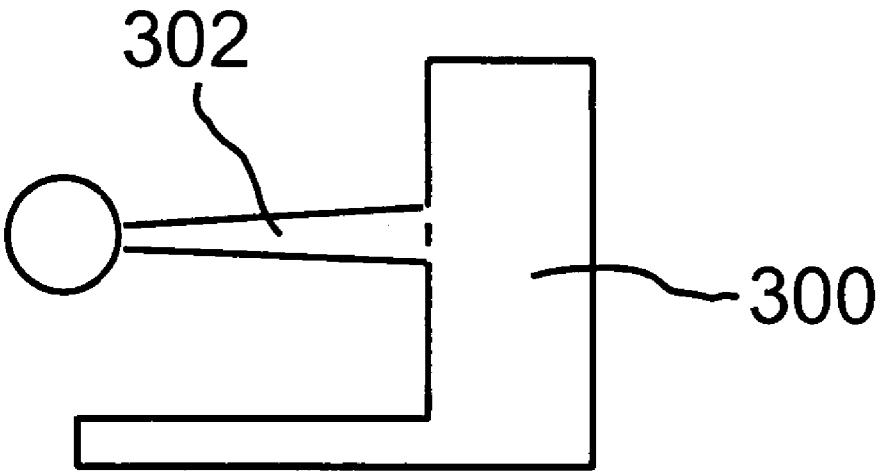
FIGS. 9 and 10 are drawings of alternative tether sections for the tether of FIGS. 6-8.
Figure 10:
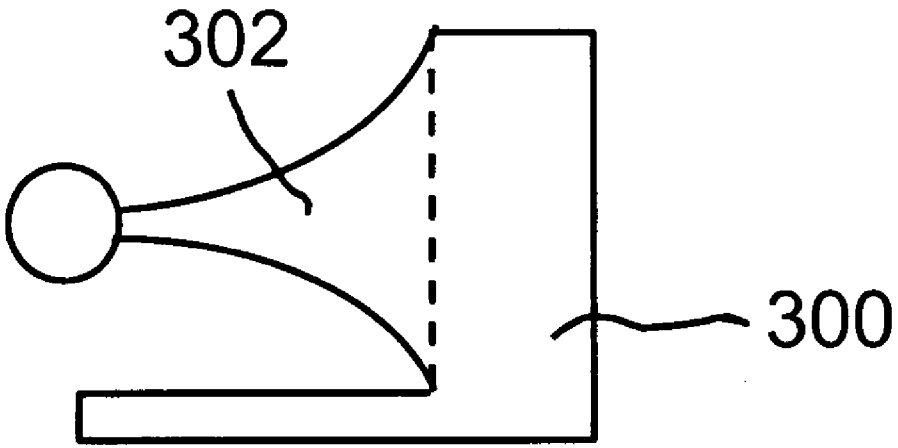

The tether 300 is shown attached to the receiver assembly 100 in the orthogonal view of FIGS. 4 and 5 and then by itself in the orthogonal views of FIGS. 6-8. As can more easily be seen in FIGS. 6 and 7, the ball 310 is at the end of a tether section or member 302 (the region to the left of the dashed line in FIG. 7). The tether section 302 is roughly triangular in shape, narrowing down where it meets the ball 310. If greater flexibility is desired, the tether section 302 could assume a more rectangular shape by decreasing the width of the tether section 302, i.e., the length of the dashed line 304, as illustrated in FIG. 9. Alternatively, the tether section 302 could have a parabolic taper, as shown in FIG. 10.

Optionally, a strain relief tab 320 may be provided for anchoring the wiring 110 connected to the receiver assembly 100 (see FIG. 4). The wiring 110 is soldered to terminals 120 on the receiver assembly 100 and affixed to the strain relief tab 320 with glue 330 or any other suitable means.

As can be seen in FIG. 8, the tether 300 may have a lengthwise right-angle cross-section, although other structures such as a U-shaped channel or a flat rectangular shape may be utilized. The angle cross-section aids in the attachment of the tether 300 to the receiver assembly 100 and also provides a surface for the strain relief 320.

If the receiver 100 is sufficiently large, a tether having two attachment points may be desired. FIGS. 11-13 illustrate such a configuration.

Figure 14:
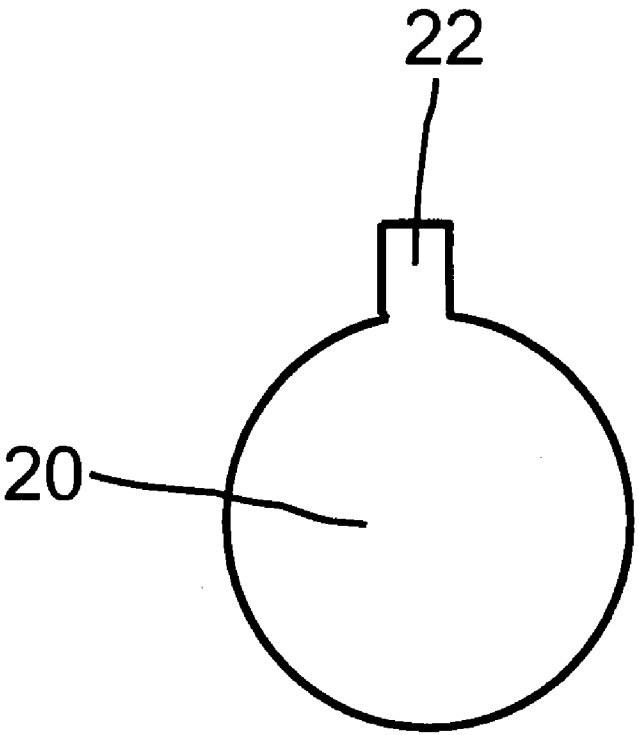
FIG. 14 is a cross-sectional view of a passage in a hearing instrument housing for a receiver tube.

To assist with the assembly and registration of the receiver assembly 100 and the receiver tube 200, a spline 210, visible in FIGS. 2 and 3, is provided along a portion of the tube 200 and mates with a keyway 22 in the passage 20 in the housing 10 (see FIG. 14). The spline 210 assures that the receiver assembly 100 is oriented (radially about the receiver tube 200) in the desired position. A flange 220 limits the travel of the tube 200 within the passage 20 where it butts up against the inside wall 24 at the entrance to the passage 20.

In the orientation of the receiver assembly 100 shown in FIG. 1, the primary component of vibration generated by the action of the receiver mechanism would be perpendicular to the page, emanating from the face 130 of the receiver assembly 100. The receiver tube 200 and the tether 300 minimize the amount of vibration coupled to the housing given such an orientation.

Figure 15:
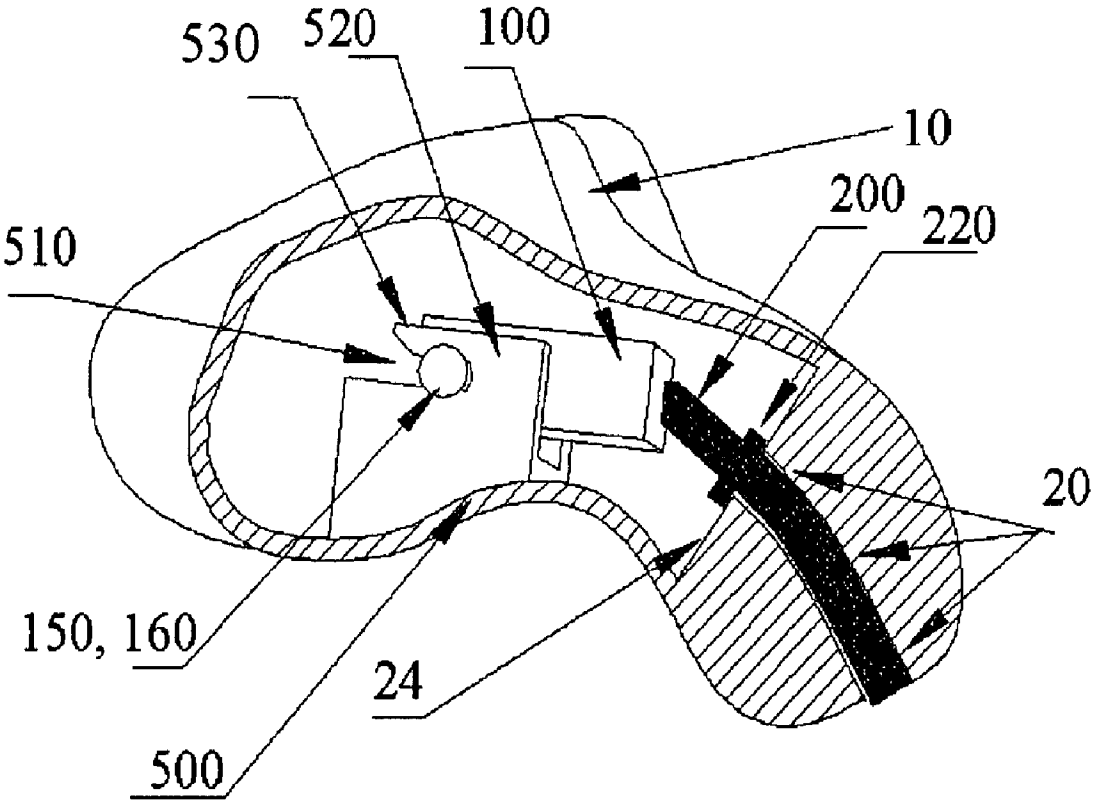
FIG. 15 is a partial cross-sectional view of another arrangement of a hearing instrument housing.

An alternative support arrangement for the receiver assembly 100 is shown in FIG. 15. There, the receiver mounting assembly comprises a cradle 500 having two slots 510 in side plates 520 that accepts an axle-assembly 150 comprising rubber studs 160 projecting outwardly from opposite faces of the receiver assembly 100. The receiver assembly 100 is held in place in part by tips 530 of the side plates 520 and allowed to rotate about the studs 150.

Figure 16:
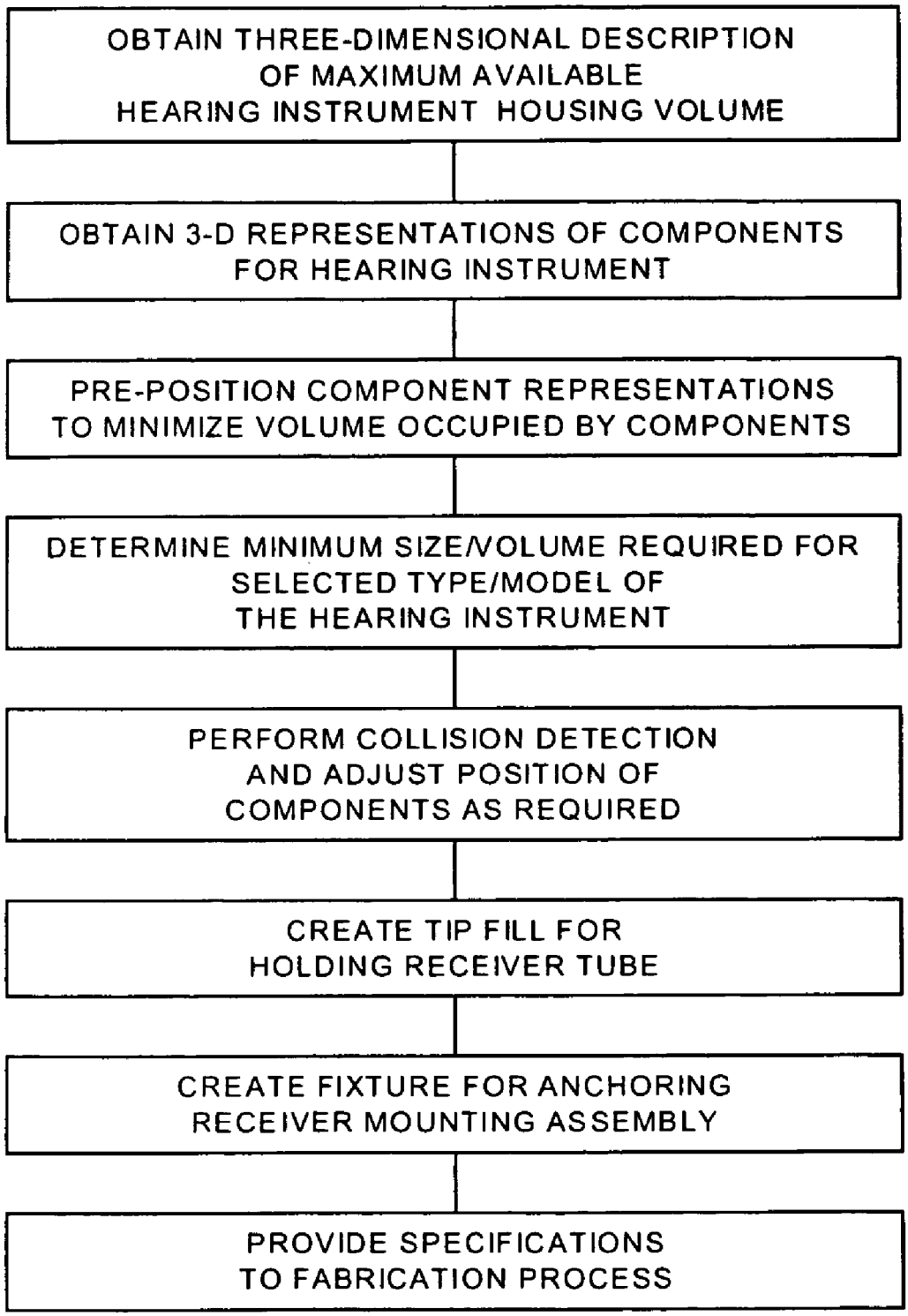
FIG. 16 is a flow chart of a procedure for designing a tether and assembling the hearing instrument.

A procedure for positioning the components within an instrument housing 10 and creating the tether 300 is shown in the flow chart of FIG. 16. Initially, a three-dimensional description of the largest volume that the hearing instrument housing 10 could occupy is required, based on the geometry of the user's ear canal and adjoining ear structure if the hearing instrument extends to the outer ear.

The components of the instrument are then determined and three-dimensional models or representations of those components are pre-positioned within the housing volume determined above. The representations are positioned in a manner that minimizes the internal volume of the housing 10 required to house the items. A test for collision detection is then performed to insure that the placement of any given component does not interfere with another component, and any necessary adjustments are performed. This is an iterative process, performed until a satisfactory configuration is achieved. In turn, the outer dimensions of the housing 10 are determined, i.e., the minimum size required to house the pre-positioned components. Since the cross-section at any given point in the ear canal is fixed, the size of the housing 10 can be adjusted by varying its length.

The tip 30 of the hearing instrument housing 10 is then filled creating a filled-in volume or tip fill 32 to provide the surrounding structure for the receiver tube passage 20 and a surface 24 for the receiver tube flange 220 (see FIGS. 1 and 14). The depth of the tip fill 30 may be set to allow for the desired length of the receiver tube 200 between the flange 220 and the receiver assembly 100. This length is selected based in part on the flexibility of the receiver tube 200 and the desired stiffness and resilience.

Since the position of the receiver assembly 100 within the housing 10 is now known, the dimensions of the tether 300 can be determined. If the configuration of FIG. 1 is used, the optional platform 420 is located on the wall 12 and the socket 410 is positioned therein. Alternatively, the socket 410 may be located in the wall 12 given a sufficiently thick outer wall 12.

The information resulting from the foregoing process may be utilized in the fabrication process, be it manual or automated. For example, the housing 10 may be fabricated using the rapid prototyping process described in U.S. patent application Ser. No. 09/887,939.

To assemble the hearing instrument, the receiver assembly 100 is inserted into the housing 10, and the receiver tube 200 is inserted into the passage 20. The spline 210 on the tube 200 is oriented according to the keyway 22, until the flange 220 on the tube 200 butts up against the inside wall 24 at the entrance of the passage 20. The tether 300 or the axle assembly 150, on the receiver assembly 100, is then anchored to the housing 10, either at the socket 410 or the cradle 500, respectively.

The dimensions of the receiver tube 200, and the location of the flange 220 thereon, and of the tether 300 and its components depend in part on the dimensions of the particular hearing instrument and the receiver assembly 100 employed. The dimensions can be determined empirically or using finite element analysis. In various prototypes, a receiver tube 200 having an outside diameter of 2.4 mm and an inside diameter of 1.4 mm, where the flange 220 is located a distance approximately 5.0 mm from the receiver assembly 100 has been found to work satisfactorily. That distance may vary from approximately 0.5-6.0 mm. Similarly, a tether 300 having a thickness of 0.4-0.5 mm, a width varying from 1 mm to 6 mm at the widest to 1 mm at the ball 310 (see FIG. 7), and a length of 2.0 mm (in a range of 0.5-5.0 mm, depending on the desired degree of resilience and stiffness), and having a ball 310 having a diameter of 1.0-1.5 mm has also been found to work satisfactorily.

Figures 17, 18:
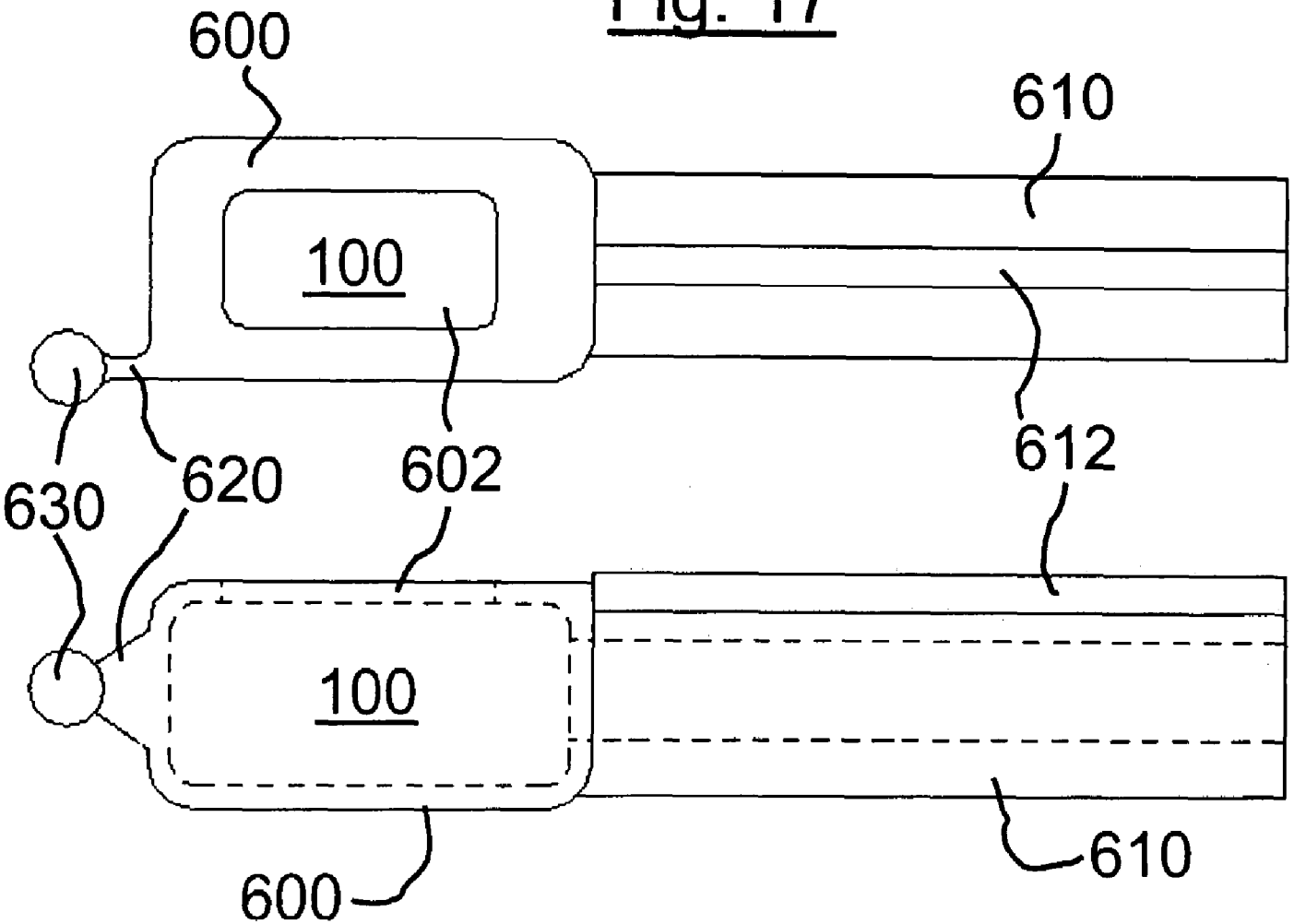
FIGS. 17 and 18 are two orthogonal views of a combined receiver boot with a tether.
Figure 19:
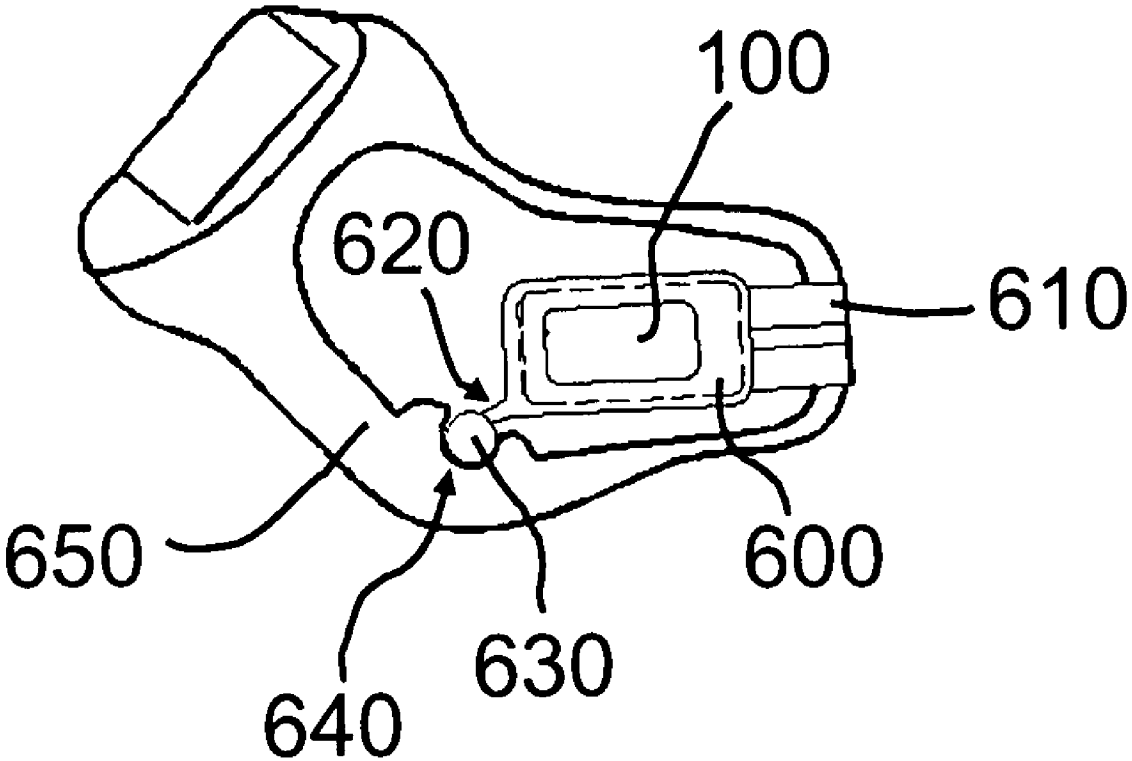
FIG. 19 illustrates the receiver boot positioned in a hearing instrument shell.

In certain applications, such as smaller hearing instruments where the entire device resides in the ear canal, the receiver assembly is considerably smaller and may be enclosed in a receiver boot fabricated from a material such as the Viton elastomer. One such an arrangement is shown in FIGS. 17-19. As shown in the figures, an outer receiver boot 600 holds the receiver assembly 100; the receiver tube 610 may be an integral part of the boot or it may be a separate component. The receiver assembly 100 is inserted into an opening 602 in the boot 600 and oriented such that its output port (not shown) is positioned adjacent the receiver tube 610. In the case where the receiver tube 610 is a separate component, a protrusion or spout may be provided on the receiver assembly 100 (not shown) to attach and support the receiver tube 610. The receiver tube 610 also has a spline 612 to aid in orientation of the receiver assembly 100 during assembly.

The boot 600 also has a tether 620 and ball 630. The tether 620 may have a length of 1-3 mm and a thickness of 0.5 mm;

the ball 630 may have a diameter of 1 mm. The receiver tube portion 610 may have a length of 1-5 mm, a diameter of 2 mm, and a wall thickness of 0.4 mm. As shown in FIG. 19, a drawing of a hearing instrument employing a receiver boot 600, the ball 630 resides in a socket 640 in the wall 650 of the hearing instrument.

Figure 21:
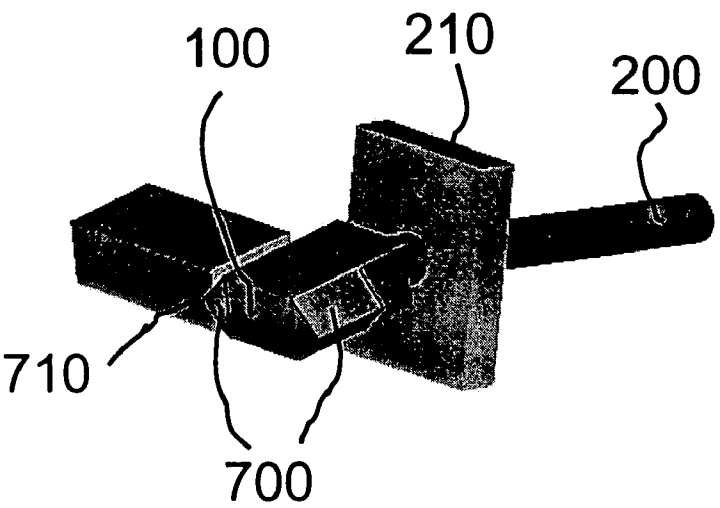
FIGS. 20-25 illustrate alternative structures for supporting a receiver assembly.
Figure 22:
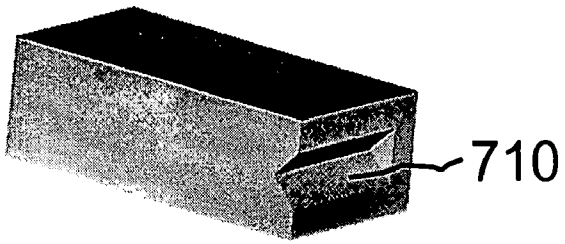
Figure 20:
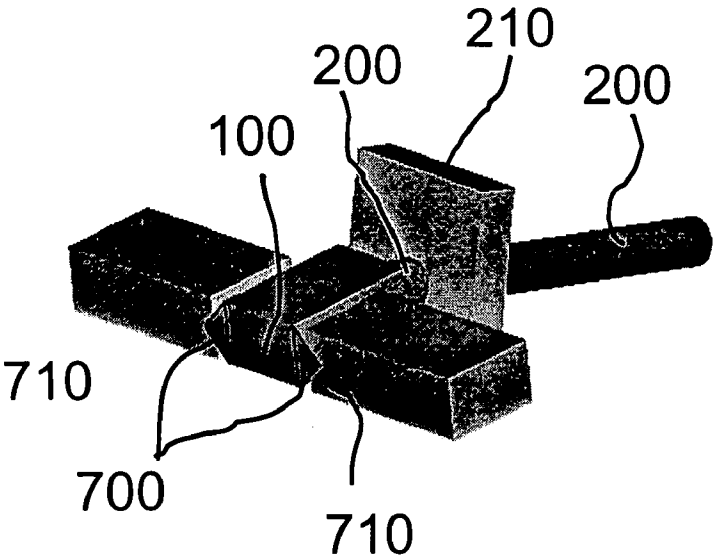

In FIGS. 20 and 21, the receiver assembly 100 is supported by yet another structure. The receiver assembly 100 is supported by a receiver tube 200 that passes through a receiver tube support 210 which may be realized as the deeper (i.e., filled) passage 20 of FIG. 1. A receiver mounting assembly, comprising a pair of mounting elements 700 is secured to the receiver assembly 100 by a suitable agent such as a glue (e.g., a cyanoacrylate). The mounting elements 700 mate with receptacles 710 that have a shape complementary to the mounting elements 700 (one shown by itself in FIG. 22) and are attached to or integral with the wall 12 of the hearing instrument housing 10 (not shown in FIGS. 20 and 21). As shown in FIGS. 20 and 21, the mounting elements 700 have a triangular cross-section. Other cross-sectional shapes, such as a trapezoid and a semi-circle, could be employed. The mounting elements 700 may be fabricated from Viton.

Figure 24:
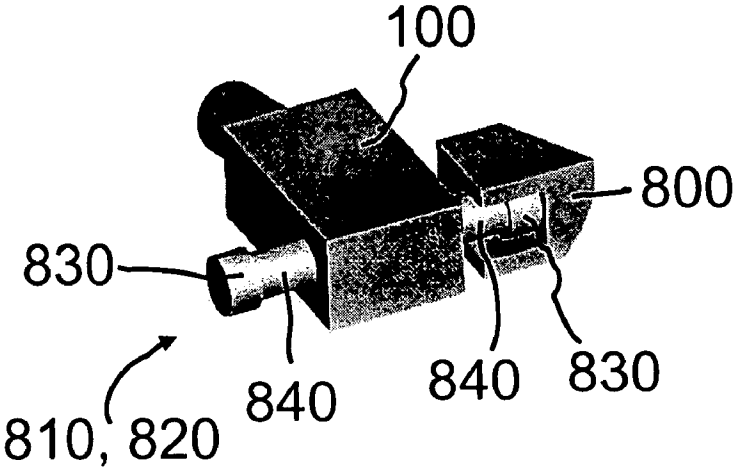
Figure 25:
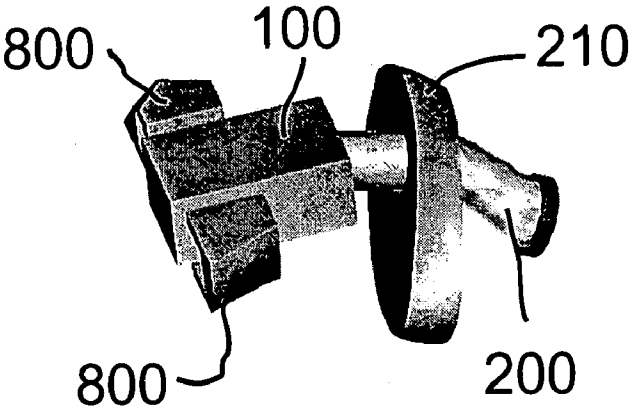
Figure 23:
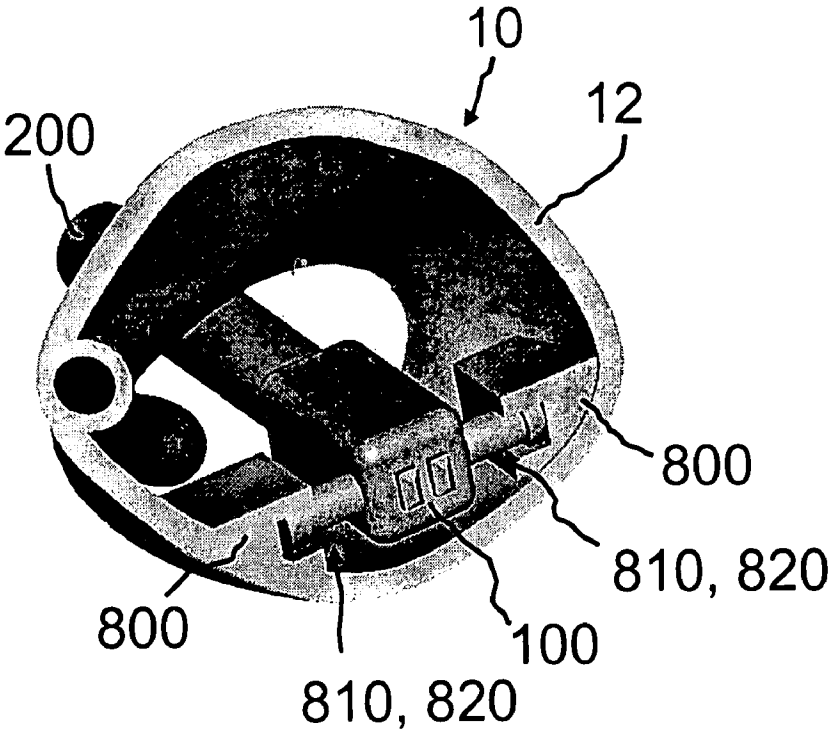

A variation of the arrangement of FIG. 15 is shown in FIGS. 23-25. Instead of the cradle 500 of FIG. 15, a pair of opposing sockets 800 attached to or integral with the wall 12 of the hearing instrument housing 10 receive a receiver mounting assembly 810 comprising opposing studs 820 attached to opposing sides of the receiver assembly 100. The end 830 of each stud 820 is wider than the shaft 840; the sockets 800 have complementing wide and narrow internal dimensions such that the ends 830 of the studs 820 snap into the sockets 800. The receiver mounting assembly 810 may also be fabricated from Viton.

What is claimed is:

1. A hearing instrument, comprising:

a housing comprising at least one receptacle;

a receiver assembly;

a receiver tube connected to the receiver assembly and attached to hearing instrument housing; and a receiver mounting assembly affixed to the receiver assembly for mounting the receiver assembly in the hearing instrument housing, where the receiver mounting assembly comprises a pair of mounting elements affixed to opposite sides of the receiver assembly;

the hearing instrument housing receptacles have a shape complementary to the shape of the mounting elements; and the receiver mounting assembly mates with the hearing Instrument housing receptacles.

2. A hearing instrument as set forth in claim 1, where the receiver mounting assembly exhibits properties of resilience and compliance.

3. A hearing instrument as set forth in claim 1, where the mounting elements have a triangular or a circular cross-section.

4. A hearing instrument as set forth in claim 1, where the hearing instruments housing receptacles comprise sockets and the mounting elements comprise opposing studs having a circular cross-section.

5. A receiver for a hearing instrument, the hearing instrument comprising a hearing instrument housing, where the hearing instrument housing comprises a passage for a receiver tube and a pair of receptacles; the receiver comprising:

a receiver assembly;

a receiver tube for insertion into the passage of the hearing instrument housing; and a receiver mounting assembly affixed to the receiver assembly for mounting the receiver assembly in the hearing instrument housing, where the receiver mounting assembly comprises a pair of mounting elements affixed to opposite sides of the receiver assembly;

the hearing instrument housing receptacles have a shape complementary to the shape of the mounting elements; and the receiver mounting assembly mates with the hearing instrument housing receptacles.

6. A receiver as set forth in claim 5, where the receiver mounting assembly exhibits properties of resilience and compliance.

7. A receiver as set forth in claim 5, where the mounting elements have a triangular or a circular cross-section.

8. A receiver as set forth in claim 5, where the hearing instrument housing receptacles comprise sockets and the mounting elements comprise opposing studs having a circular cross-section.

9. A receiver mounting assembly for mounting a receiver assembly in a hearing instrument housing, where the hearing instrument housing comprises a pair of receptacles, the receiver comprising a pair of mounting elements affixed to opposite sides of the receiver assembly, where the mounting elements mate with the hearing instrument housing receptacles.

10. A receiver mounting assembly as set forth in claim 9, where the assembly exhibits properties of resilience and compliance.

11. A receiver mounting assembly as set forth in claim 9, where the hearing instrument housing receptacles have a shape complementary to the shape of the mounting elements.

12. A receiver mounting assembly as set forth in claim 11, where the mounting elements have a triangular or a circular cross-section.

13. A receiver mounting assembly as set forth in claim 11, where the mounting elements comprise opposing studs having a circular cross-section and the hearing instrument housing receptacles comprise sockets.

14. A method for assembling a hearing instrument comprising a hearing instrument housing comprising a pair of receptacles and a passage for a receiver tube;

a receiver assembly;

a receiver tube connected to the receiver assembly and attached to the hearing instrument housing; and a receiver mounting assembly affixed to the receiver assembly for mounting the receiver assembly in the hearing instrument housing, where the receiver mounting assembly comprises a pair of mounting elements affixed to opposite sides of the receiver assembly;

the hearing instrument housing receptacles have a shape complementary to the shape of the mounting elements; and the receiver mounting assembly mates with the hearing instrument housing receptacles;

the method comprising:

inserting the receiver assembly into the hearing instrument housing;

inserting the receiver tube into the passage; and mating the receiver mounting assembly with the hearing instrument housing receptacles.

15. A method as set forth in claim 14, where the mounting elements comprise opposing studs having a circular cross-section and are affixed to opposite sides of the receiver assembly and the hearing instrument housing receptacles comprise sockets, and the step of mating comprises inserting the studs into the sockets.

16. A method for fabricating a hearing instrument, the hearing instrument comprising a hearing instrument housing comprising a pair of receptacles and a passage for a receiver tube;

a receiver assembly;

a receiver tube connected to the receiver assembly and attached to the hearing instrument housing; and a receiver mounting assembly affixed to the receiver assembly for mounting the receiver assembly in the hearing instrument housing, where the receiver mounting assembly comprises a pair of mounting elements affixed to opposite sides of the receiver assembly;

the hearing instrument housing receptacles have a shape complementary to the shape of the mounting elements; and the receiver mounting assembly mates with the hearing instrument housing receptacles;

the method comprising:

obtaining a three-dimensional representation of the volume for a hearing instrument housing;

obtaining three-dimensional representations of the components for the hearing instrument;

positioning the components within the hearing instrument housing, the step of positioning comprising positioning the components in a fashion that minimizes the internal volume of the hearing instrument housing;

locating a passage for the receiver tube in the hearing instrument housing; and locating the hearing instrument housing receptacles in the hearing instrument housing.

17. A method as set forth in claim 16, where the step of positioning the components within the hearing instrument housing comprises performing a collision detection for the components.

* * * * *